US005707328A

United States Patent [19]

Sato et al.

[11] Patent Number: 5,707,328

[45] Date of Patent: Jan. 13, 1998

[54] METHOD AND APPARATUS FOR MANUFACTURING PAPER TUBE

[75] Inventors: Hiroki Sato; Shigehisa Shimizu, both of Kanagawa-Ken, Japan

[73] Assignee: Fuji Photo Film Co., Ltd., Kanagawa, Japan

[21] Appl. No.: 519,093

[22] Filed: Aug. 24, 1995

[30] Foreign Application Priority Data

Aug. 29, 1994 [JP] Japan ..... 6-203300

[51] Int. Cl.[6] ..... B31C 11/04

[52] U.S. Cl. ..... 493/279; 493/337; 493/299

[58] Field of Search ..... 493/274, 272, 493/281, 280, 279, 278, 299, 332, 333, 335, 337; 118/258, 118, 262, 240, 241, 242, 243

[56] References Cited

U.S. PATENT DOCUMENTS

| | | | |
|---|---|---|---|
| 2,066,991 | 1/1937 | Lutz | 493/274 |
| 2,307,142 | 1/1943 | Lee | 493/337 |
| 3,212,412 | 10/1965 | Langan et al. | 493/332 |
| 3,228,308 | 1/1966 | Denenberg | 493/274 |
| 3,906,843 | 9/1975 | Hewitt | 493/333 |
| 4,061,109 | 12/1977 | Allen | 118/118 |
| 4,425,106 | 1/1984 | Boegli | 493/333 |
| 4,737,378 | 4/1988 | Narita et al. | 11/247 |
| 5,318,499 | 6/1994 | Rice et al. | 493/299 |
| 5,586,963 | 12/1996 | Lennon et al. | 493/299 |

FOREIGN PATENT DOCUMENTS

| | | | |
|---|---|---|---|
| 1033100 | 4/1953 | France | 14/2 |
| 2303607 | 3/1976 | France | B05C 11/02 |

OTHER PUBLICATIONS

Patent Abstracts of Japan, vol. 015, No. 503 (P-1290), Dec. 19, 1991; JP-A-03 217839 (Fuji Photo Film Co Ltd.), Sep. 25, 1991, *abstract.

*Primary Examiner*—James F. Coan
*Assistant Examiner*—John Paradiso
*Attorney, Agent, or Firm*—Sughrue, Mion, Zinn, Macpeak & Seas, PLLC

[57] ABSTRACT

The moisture content of a base paper for manufacturing a paper tube is controlled to a predetermined value. Water-soluble adhesive is applied to a side of the base paper in such a small amount as to cause the adhesive to ridge on the side of the base paper, and the ridging adhesive is uniformly smoothed over the side of the base paper. The base paper is wound into a tube.

19 Claims, 2 Drawing Sheets

METHOD AND APPARATUS FOR MANUFACTURING PAPER TUBE

BACKGROUND OF THE INVENTION

1. Field of the Invention

This invention relates to a method of and apparatus for manufacturing a paper tube such as a core for rolling up a sensitized material in a continuous length.

2. Description of the Related Art

A sensitized material like photographic film is generally handled in a continuous length during and/or after manufacture. In order to facilitate handling, such a sensitized material in a continuous length is usually rolled up around a paper core. The paper core is generally manufactured by spirally winding a tape-like base paper coated with water-soluble adhesive around a mandrel a plurality of times to form a cylindrical tube.

A sensitized material is deteriorated in a photosensitive performance by moisture, and in the case of a photographic film, the quality of pictures is deteriorated by moisture.

When stored under a high humidity condition (not lower than 80% in relative humidity), a paper material absorbs moisture, which results in stretch and/or wrinkle of the material and in deterioration of quality of the material. Accordingly the water content of the core for a sensitized material is to be as small as possible not to deteriorate the photosensitive performance of the material.

Though the moisture content of the core for a sensitized material may be reduced by using base paper which is low in moisture content, the paper becomes more brittle as the moisture content lowers and the paper core formed thereof becomes unsatisfactory in strength. In order to obtain a paper core sufficient in strength, the moisture content of the base paper should be not less than 5% and accordingly this approach cannot satisfactorily overcome the problem described above.

As another approach, the moisture content of the core may be reduced by using an adhesive which is low in moisture content, that is, high in solid content. However as the adhesive becomes more concentrated, the viscosity of the adhesive becomes higher and it becomes difficult to apply the adhesive in a thin film. For example, when applied by a roll coater, the adhesive exhibits satisfactory film forming properties (less in unevenness or coating marks) only when the adhesive has a viscosity in the range of 1000 to 10000 mPas at 20° C. as measured by a Brookfield viscometer. However, when an adhesive which is 45% in concentration and 6000 mPas in viscosity is concentrated to 50%, the viscosity increases up to about 30000 mPas and the film forming properties deteriorate.

The moisture content of the core may be reduced by drying the finished core to a desired moisture content. However, this approach is disadvantageous in that facilities and spaces for drying finished cores, add to the manufacturing cost.

In order to shorten the drying time, excessive adhesive has been scraped off with a sharp doctor knife just after the water-soluble adhesive is applied to the base paper. However, this method is disadvantageous in that the amount of the adhesive left on the base paper is apt to become ununiform due to fluctuation in tension on the base paper and accordingly, it is difficult to stably apply a small amount of adhesive to the base paper.

There have been developed various paper cores which can be manufactured without using water-soluble adhesive and methods of manufacturing the same. For example, in accordance with the technique disclosed in Japanese Patent Publication No. 58(1983)-48342 or Japanese Unexamined Patent Publication No. 60(1985)-143948, composite base paper comprising base paper and a synthetic resin layer formed on one or both sides of the base paper is heated to melt or soften the resin layer and is wound a plurality of times to form a tube so that the overlapped parts of the composite base paper are bonded together with the molten or softened resin.

However this method is disadvantageous in that since the composite base paper is heated to 100° C. to 200° C. to melt or soften the resin layer, the finished core is still hot just after manufacture and accordingly if a sensitized material, which is low in heat resistance, is rolled up around the core soon after manufacture, the sensitized material can be damaged.

Accordingly, the paper core of the composite base paper must be cooled for about two hours under normal temperatures before rolling up the sensitized material. In order to reduce the cooling time, a special cooling facility is required.

SUMMARY OF THE INVENTION

In view of the foregoing observations and description, the primary object of the present invention is to provide a method and an apparatus which can manufacture a paper tube or a paper core low in moisture content in such a manner that a sensitized material can be rolled up around the core soon after manufacture of the core.

The method of the present invention comprises the steps of controlling the moisture content of base paper to a predetermined value, applying water-soluble adhesive to a side of the base paper in such a small amount as to cause the adhesive to ridge on the side of the base paper, uniformly smoothing the ridging adhesive over the side of the base paper and winding the base paper into a tube.

In this specification, the expression "the adhesive ridges" means that the adhesive is unevenly applied in a state where adhesive film is formed in some part and little adhesive film is formed in some part.

The predetermined value to which the moisture content of the base paper is controlled is preferably not lower than 5% from the viewpoint of ensuring the strength of the finished paper core and is preferably as low as possible from the viewpoint of reducing the moisture content of the finished paper core. Accordingly, the predetermined value is preferably in the range of 5 to 7%.

As the water-soluble adhesive, those which can form adhesive film without deterioration in initial bond strength even at a high concentration are preferred. For this purpose, blended adhesives of a plurality of kinds of adhesives different from each other in concentration are preferred. As the water-soluble adhesive, polyvinyl acetate polymer emulsion, aqueous solution of glue, water-glass, and the like can be employed. Among those, polyvinyl acetate polymer emulsion is preferable in view of easiness in handling.

When preparing polyvinyl acetate polymer emulsion, vinyl acetate alone or with a small amount of copolymerizable monomer is polymerized by a known emulsion polymerization method. As the copolymerizable monomer, ethylene, styrene, acrylic acid, methacrylic acid, crotonic acid, maleic acid and esters of them can be employed. PVA used as the protective colloid should be in an amount of 2 to 20 wt % of polyvinyl acetate polymerizable solid content.

Though the protective colloid may be added at the beginning, in the course of or at the end of emulsion polymerization, it is generally added at the beginning or in the course of the emulsion polymerization. As a polymerization catalyst, any of peroxides such as hydrogen peroxide or potassium persulfate may be used. Other compounds such as various surface-active agents, water-soluble protective colloids, pH adjustors and the like may be used in addition.

The preparing polyvinyl acetate polymer emulsion thus obtained may be used as it is or may be added as desired with a film forming auxiliary such as plasticizer, high-boiling solvent and the like; extender pigment such as clay, calcium carbonate and kaolin; color pigment such as titanium oxide; antiseptic agent; insecticide; thickening agent and the like. Further, curing agent such as metallic salt, glyoxal, boric acid and the like may be added to the polyvinyl acetate polymer emulsion.

The base paper may be of any type so long as it does not adversely affect the sensitized material to be rolled up. For example, the base paper may be of chemical pulp such as SP or KP, semi-chemical pulp such as CTMP or CGP or mechanical pulp. Further, wastepaper of newspaper or corrugated board may also be used. Base papers which generate less sulfide, formalin or the like (e.g., neutral paper disclosed in Japanese Unexamined Patent Publication No. 3(1991)-180583) are especially preferable. These base papers may be used alone or as a mixture.

Preferably, the base paper is 0.2 to 1.0 mm in thickness and 150 to 750 g/m$^2$ in weight. In order to prevent staining of the surface and peeling of the cut surface, it is preferred that decorative paper be wound on the uppermost layer. Preferably, the decorative paper is 0.05 mm to 0.20 mm in thickness.

The dimensions of the paper depends on the applications thereof. For example, in the case of a core for a sensitized material for computer phototypography, the core is usually 18 to 153.2 mm in inner diameter and 21 to 165.2 mm in outer diameter. In the case of a core for printing sensitized material, the core is 50.7 to 78 mm in inner diameter and 56.7 to 89 mm in outer diameter. In the case of a core for color paper, the core is usually 76.2 mm in inner diameter and 83.2 to 87.2 mm in outer diameter.

The apparatus of the present invention comprises a moisture content controlling means which controls the moisture content of base paper to a predetermined value, a coating means which applies water-soluble adhesive to a side of the base paper in such a small amount as to cause the adhesive to ridge on the side of the base paper, a smoothing means which uniformly smoothes the ridging adhesive over the side of the base paper and a winding means which winds the base paper into a tube.

As the smoothing means, there have been known a smoothing bar, a smoother roller and the like.

The coating means may comprise, for instance, a rotatable first roll to which the water-soluble adhesive is supplied to adhere to the peripheral surface thereof, a rotatable second roll which is disposed close to the first roll at a predetermined space therefrom so that the water-soluble adhesive on the first roll is transferred to the peripheral surface of the second roll and applies the transferred water-soluble adhesive to the base paper, a space controller which controls the space between the first and second rolls so that the water-soluble adhesive is applied to the base paper in such a small amount as to cause the adhesive to ridge on the side of the base paper, and a drive means which rotates the first and second rolls.

The space between the first and second rolls is preferably 0.04 to 0.08 mm in the case where the adhesive is to be applied in an amount of 18 to 26 g/m$^2$.

The paper tube manufactured in accordance with the present invention may be used for various applications. For example, it may be employed as a core for a photographic sensitized material magazine which is disclosed in Japanese Unexamined Patent Publication No. 61(1986)-219040 and the like.

When the paper tube is used as the core for a photographic sensitized material magazine, the paper tube is provided with a bearing such as a fixed cylindrical member of paper (see, for instance, Japanese Unexamined Patent Publication No. 61(1986)-219040 and the like), a bearing of a pulp molding (see, for instance, Japanese Unexamined Patent Publication No. 62(1987)-248434 and the like) and a bearing formed by plastic injection molding. The bearing in the form of the cylindrical member of paper is disadvantageous in that to accurately fix the cylindrical member is difficult and requires a long time. The bearing of a pulp molding and that formed by plastic injection molding are advantageous over the cylindrical member in that they can be formed with a high accuracy, and the former is advantageous over the latter in that the former can be discarded more easily than the latter.

The method of pulp molding is divided into a vacuum forming method and a press molding method. The vacuum forming method is used for forming an article which may be low in strength (e.g., a chicken tray) and the press molding method is used for forming an article which should be relatively high in strength. In the former method, a metal mesh is stretched over a mold having a number of perforations, the mold with the metal mesh is dipped in a pulp solution and sucked under a suction force so that the pulp fibers adhere to the metal on the outer side of the mold, and the pulp fibers are released from the mold and dried. In the latter method, a pulp solution injected into a frame is pressed between male and female molds having a number of perforations and is molded while dehydrating the pulp.

Preferably the bearing is easy to discard, uniform in wall thickness, accurate in dimensions and relatively high in strength and at the same time can be manufactured at low cost without generating wastage. When manufacturing such a bearing by the pulp molding, imported or domestic corrugated board wastepaper, virgin pulp, deinked newspaper and neutral high-yield pulp are preferred and fine paper containing ink and/or fluorescent agent, imitation Japanese vellum, magazine wastepaper and coated paper are not preferred as the base paper of the bearing in view of influence on the photographic sensitized material. From the viewpoint of strength, base papers containing corrugated board wastepaper, neutral high-yield pulp, LBKP, NUKD, NBKP and/or NBSP in an amount not less than 50% are preferred, and wastepaper of newspaper, magazine or fine paper is not preferred.

The core may be used for rolling up, for instance, photographic paper, microfilm, photosensitive resin film, heat-sensitive paper, photographic paper for computer phototypography, microfilm for a computer, Lith film, auto-positive printing paper, photographic film for phototypography, photographic paper for phototypography, and diazonium photographic paper in a continuous length.

Thus, in accordance with the present invention, by controlling the moisture content of base paper to a predetermined value and taking into account the strength of the finished paper tube, the moisture content of the finished paper tube is lowered without weakening the paper tube and by applying water-soluble adhesive in such a small amount as to cause the adhesive to ridge on the side of the base paper, the moisture content of the finished paper tube is further lowered.

DESCRIPTION OF THE PREFERRED EMBODIMENT

Figure 1:
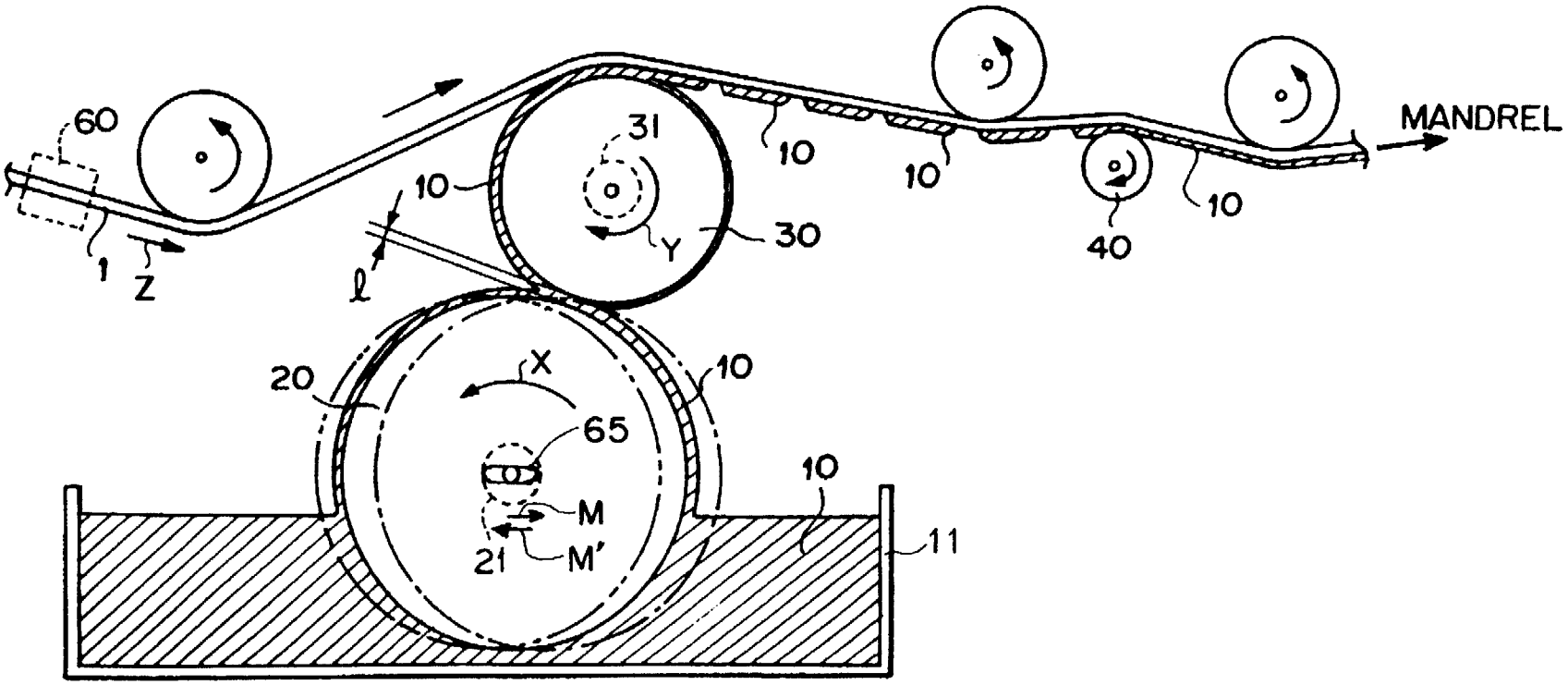
FIG. 1 is a schematic view showing an example of a coating means for applying water-soluble adhesive in a paper tube manufacturing apparatus in accordance with an embodiment of the present invention.
Figure 2:
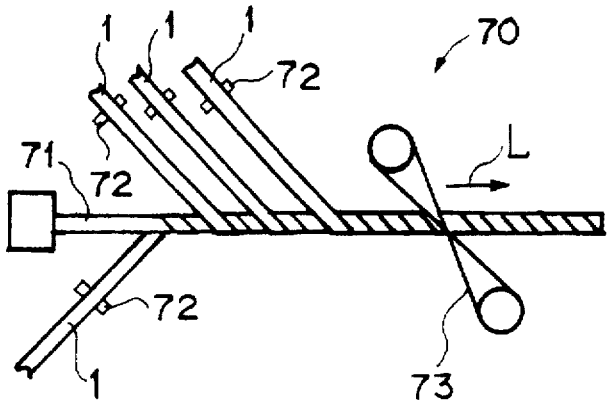
FIG. 2 is a schematic view showing an example of a winding means for winding the base paper into a tube in the paper tube manufacturing apparatus.

In FIGS. 1 and 2, a paper tube manufacturing apparatus in accordance with an embodiment of the present invention comprises a moisture content controlling means 60 which controls the moisture content of base paper 1 in a continuous length within a-predetermined range (e.g., 6±1%), a coating means which applies water-soluble adhesive 10 to one side of the base paper 1 in such a small amount as to cause the adhesive 10 to ridge on the side of the base paper 1, a smoothing bar 40 which uniformly smooths the ridging adhesive over the side of the base paper 1 and a winding means 70 which winds the base paper 1 into a tube.

The coating means comprises a rotatable bottom roll 20 which is disposed so that its peripheral surface is partly dipped in the water-soluble adhesive 10 stored in an adhesive reservoir 11, a rotatable coating roll 30 which is disposed close to the bottom roll 20 at a predetermined space l therefrom so that the water-soluble adhesive 10 on the peripheral surface of the bottom roll 20 is transferred to the peripheral surface of the coating roll 30 and applies the transferred water-soluble adhesive 10 to the base paper 1, a space controller 65 which controls the space l between the rolls 20 and 30 so that the water-soluble adhesive 10 is applied to the base paper 1 in such a small amount as to cause the adhesive 10 to ridge on the side of the base paper 1, and a pair of drive means 21 and 31 which respectively rotate the rolls 20 and 30.

The winding means 70 comprises a mandrel 71 around which the base paper 1 applied with the adhesive 10 is wound, a guide 72 which guides the base paper 1 to the mandrel 71 and a press belt 73 which presses the base paper 1 wound around the mandrel 71 against the mandrel 71 and causes the base paper 1 to slide in the direction of arrow L away from the mandrel 71.

In FIG. 1, the base paper 1 is in the form of a tape in a continuous length and is fed in the direction of arrow Z while being wound around the mandrel 71. The base paper 1 is first passed through the moisture content controlling means 60 and the moisture content of the base paper 1 is controlled to a value within said predetermined range. In this particular embodiment, the lower limit of the predetermined range is set to 5% from the viewpoint of ensuring the strength of the finished paper tube and the upper limit of the same is set to 7% from the viewpoint of reducing the moisture content of the finished paper tube.

A predetermined amount of the water-soluble adhesive 10 stored in the reservoir 11 adheres to the peripheral surface of the bottom roll 20 to rotate together with the bottom roll 20 which is rotated in the direction of arrow X by the drive means 21 and a part of the water-soluble adhesive 10 on the bottom roll 20 is transferred to the coating roll 30 which is rotated in the direction of arrow Y by the drive means 31. Further, a part of the water-soluble adhesive 10 on the coating roll 30 is transferred to one side of the base paper 1 passed around the coating roll 30.

Figure 3:
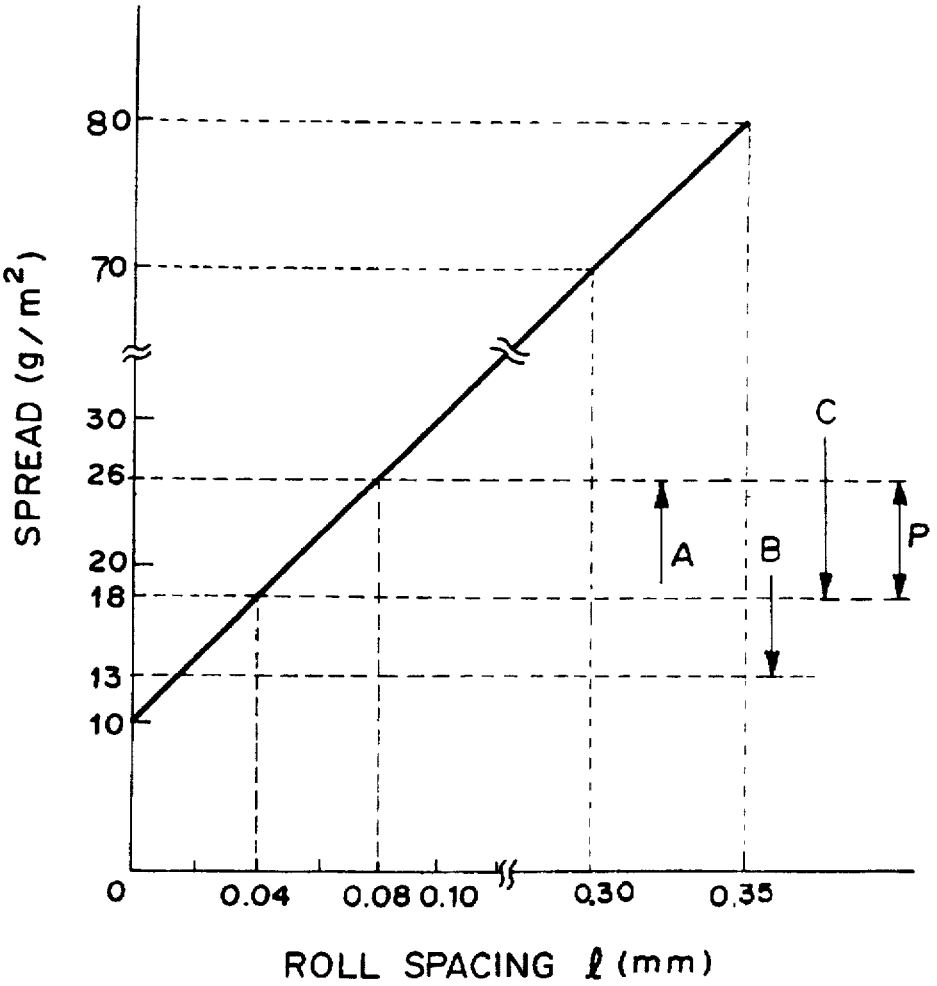
FIG. 3 is a graph showing the relation between the roll spacing and the amount of adhesive to be applied to the base paper.

The space controller 65 moves the bottom roll 20 in the direction of arrow M or arrow M' to adjust the space l between the bottom roll 20 and the coating roll 30 from 0 to 0.35 mm. The amount of the water-soluble adhesive 10 to be transferred from the bottom roll 20 to the coating roll 30 changes with change in the space l between the bottom roll 20 and the coating roll 30. As the amount of water-soluble adhesive 10 to be transferred from the bottom roll 20 to the coating roll 30 changes, the amount of the water-soluble adhesive 10 transferred or applied to the base paper 1 changes. FIG. 3 shows the relation between the roll spacing l and the amount of adhesive to be applied to the base paper 1. As can be understood from FIG. 3, the amount of the water-soluble adhesive 10 applied to the base paper 1 is 80 $g/m^2$ at the maximum in the range of the roll spacing l of 0 to 0.35 mm. The roll spacing l may be adjusted by moving the coating roll 30 instead of moving the bottom roll 20.

The water-soluble adhesive 10 tends to ridge as shown in FIG. 1 when applied in a small amount, e.g., not larger than 80 $g/m^2$. The smoothing bar 40 uniformly smooths the ridging adhesive 10 over the side of the base paper 1, whereby a small amount of the adhesive 10 is uniformly applied to the base paper 1 without ridging.

The base paper 1 which has been uniformly applied with a small amount of the water-soluble adhesive and whose moisture content has been controlled to a value within the predetermined range is guided to a predetermined position on the mandrel 71 by the guide 72 and spirally wound around the mandrel 71 as shown in FIG. 2. A plurality of the base papers 1 are wound around the mandrel 71 in different positions to form multiple layers. Then the press belt 73 presses against the mandrel 71 the base papers 1 spirally wound in a multiple layers into a tube and causes the formed tube to slide in the direction of arrow L away from the mandrel 71.

The paper tube thus discharged from the mandrel 71 can be lower in moisture content without deterioration in strength. As a result, the finished tube need be neither dried nor cooled, and, accordingly, the time and the space required to dry or cool the finished tube can be eliminated. Further, a sensitized material can be rolled up around the tube even just after manufacture of the tube.

EXAMPLE

We have found that when the amount of the water-soluble adhesive 10 applied to the base paper 1 is in the range of 18 to 26 $g/m^2$ (indicated at P in FIG. 3), the best result can be obtained. In order to apply the water-soluble adhesive 10 in an amount within the range, the space l between the rolls 20 and 30 was set in the range of 0.04 to 0.08 mm. The preferred range of the amount of the water-soluble adhesive 10 (18 to 26 $g/m^2$) is determined by the range (indicated at A) of amount of the water-soluble adhesive 10, the upper limit of the moisture content, the range (indicated at B) of amount of the water-soluble adhesive 10 within which the adhesive can be uniformly spread by the smoothing bar and the range (indicated at C) of amount of the water-soluble adhesive 10 within which a sufficient compression strength of the tube can be ensured. When the amount of the water-soluble adhesive 10 applied to the base paper 1 is in the range of 18 to 26 g/m$^2$, the moisture content and the compression strength of the finished tube can be stably less than 9.5% and not less than 70 kgf/8.25 cm, respectively, whereby a very useful paper tube can be obtained.

When the whole apparatus is installed in a space in which the temperature and the humidity are kept within a range of 23°±3° C. and a range of 45±3% RH, respectively, the moisture content of the base paper 1 can be held within the range described above over the entire steps of manufacturing the paper tube, which is more preferred.

The following table shows the moisture contents and the compression strengths of paper tubes manufactured by use of the apparatus of the embodiment described above under different conditions.

TABLE

| Ex. No. | s/c | mean spread | m/c of b/p | m/c of p/p | c/s |
|---|---|---|---|---|---|
| 1 | 45% | 18 g/m$^2$ | 5% | about 8.5% | ≧75kgf/8.25 |
| 2 | 45% | 22 g/m$^2$ | 7% | about 11.2% | ≧75kgf/8.25 |
| 3 | 45% | 26 g/m$^2$ | 7% | about 12.0% | ≧85kgf/8.25 |
| 4 | 50% | 18 g/m$^2$ | 5% | about 8.2% | ≧78kgf/8.25 |
| 5 | 50% | 26 g/m$^2$ | 7% | about 9.2% | ≧85kgf/8.25 |

s/c = solid content in the adhesive, m/c of b/p = moisture content in the base paper, m/c of p/p = moisture content in the paper tube just after manufacture, c/s = compression strength of the paper tube just after manufacture As can be understood from the table above, it has been found that the solid content of the water-soluble adhesive 10 is preferably not less than 50%.

Further, the moisture content and the compression strength of the paper tube were constant without depending on the tube forming speed (0 to 20 m/min).

Thus in, accordance with the present invention, by controlling the moisture content of base paper to a predetermined value, the moisture content of the finished paper tube is lowered without weaken the paper tube and by applying water-soluble adhesive in such a small amount as to cause the adhesive to ridge on the side of the base paper, the moisture content of the finished paper tube is further lowered. Ridging of the water-soluble adhesive can be removed by uniformly smoothing the adhesive.

That is, by controlling the moisture contents of the materials for making the paper tube to low levels, the moisture content of the finished paper tube can be low without weakening the mechanical strength of the finished paper tube.

Accordingly the finished tube need be neither dried nor cooled, and accordingly the time and the space required to dry or cool the finished tube can be eliminated. Further, a sensitized material can be rolled up around the tube even just after manufacture of the tube.

What is claimed is:

1. A method of manufacturing a paper tube comprising the steps of controlling the moisture content of base paper to a predetermined value, applying water-soluble adhesive to a side of the base paper in such a small amount as to cause the adhesive to ridge on the side of the base paper, uniformly smoothing the ridging adhesive over the side of the base paper and winding the base paper into a tube.

2. An apparatus for manufacturing a paper tube comprising a moisture content controlling means which controls the moisture content of base paper to a predetermined value, a coating means which applies water-soluble adhesive to a side of the base paper in such a small amount as to cause the adhesive to ridge on the side of the base paper, a smoothing means which uniformly smoothes the ridging adhesive over the side of the base paper and a winding means which winds the base paper into a tube.

3. An apparatus as defined in claim 2 in which said coating means comprises a rotatable first roll to which the water-soluble adhesive is supplied to adhere to the peripheral surface thereof, a rotatable second roll which is disposed close to the first roll at a predetermined space therefrom so that the water-soluble adhesive on the first roll is transferred to the peripheral surface of the second roll and applies the transferred water-soluble adhesive to the base paper, a space controller which controls the space between the first and second rolls so that the water-soluble adhesive is applied to the base paper in such a small amount as to cause the adhesive to ridge on the side of the base paper, and a drive means which rotates the first and second rolls.

4. A method of manufacturing a paper tube as claimed in claim 1, wherein the predetermined value is a moisture content within the range between approximately 5% and approximately 7%.

5. An apparatus for manufacturing a paper tube as claimed in claim 2, wherein the predetermined value is a moisture content within the range between approximately 5% and approximately 7%.

6. An apparatus for manufacturing a paper tube as claimed in claim 3, wherein the predetermined value is a moisture content within the range between approximately 5% and approximately 7%.

7. A method of manufacturing a paper tube as claimed in claim 1, wherein the water-soluble adhesive is selected from the group consisting of:

polyvinyl acetate polymer emulsion;

aqueous solution or glue; and water-glass.

8. A method of manufacturing a paper tube as claimed in claim 1, wherein the water-soluble adhesive is a blend of at least two kinds of adhesives.

9. A method of manufacturing a paper tube as claimed in claim 7, wherein said water-soluble adhesive consists of polyvinyl acetate polymer emulsion, which is prepared using vinyl acetate alone or a small amount of copolymerizable monomer, said copolymerizable monomer selected from the group consisting of:

ethylene;

styrene;

acrylic acid;

methacrylic acid;

crotonic acid;

maleic acid; and esters.

10. A method of manufacturing a paper tube as claimed in claim 7, wherein said water-soluble adhesive contains a polyvinyl acetate polymerizable solid content in an amount with the range of approximately 2 to 20 wt %.

11. A method of manufacturing a paper tube as claimed in claim 1, wherein said base paper is selected from the group consisting of:

chemical pulp;

semi-chemical pulp;

mechanical pulp;

newspaper; and corrugated board.

12. A method of manufacturing a paper tube as claimed in claim 1, wherein said base paper is a blend of at least two kinds of paper.

13. A method of manufacturing a paper tube as claimed in claim 1, wherein said small amount is not greater than approximately 80 $g/m^2$.

14. A method of manufacturing a paper tube as claimed in claim 13, wherein said small amount is within the range of approximately 18 to 26 $g/m^2$.

15. An apparatus for manufacturing a paper tube as claimed in claim 2, wherein said small amount is not greater than approximately 80 $g/m^2$.

16. An apparatus for manufacturing a paper tube as claimed in claim 3, wherein said space between the first and second rolls may be adjusted.

17. An apparatus for manufacturing a paper tube as claimed in claim 16, wherein said space between the first and second rolls may be adjusted within the range between 0 and approximately 0.35 mm.

18. An apparatus for manufacturing a paper tube as claimed in claim 2, wherein said water-soluble adhesive has a solid content between approximately 45% and approximately 50%.

19. A method of manufacturing a paper tube as claimed in claim 1, wherein said waster-soluble adhesive has a solid content between approximately 45% and approximately 50%.

* * * * *